US009841197B2

(12) United States Patent
Sato et al.

(10) Patent No.: US 9,841,197 B2
(45) Date of Patent: Dec. 12, 2017

(54) HOT WATER SUPPLY APPARATUS

(71) Applicant: RINNAI CORPORATION, Nagoya-shi, Aichi (JP)

(72) Inventors: Eri Sato, Nagoya (JP); Ai Yuge, Nagoya (JP)

(73) Assignee: RINNAI CORPORATION, Nagoya-shi, Aichi (JP)

( * ) Notice: Subject to any disclaimer, the term of this patent is extended or adjusted under 35 U.S.C. 154(b) by 189 days.

(21) Appl. No.: 14/714,481

(22) Filed: May 18, 2015

(65) Prior Publication Data

US 2015/0354832 A1 Dec. 10, 2015

(30) Foreign Application Priority Data

Jun. 6, 2014 (JP) ..... 2014-117875

(51) Int. Cl.

| | |
|---|---|
| ***F24D 17/00*** | (2006.01) |
| ***F24H 1/14*** | (2006.01) |
| ***E03B 7/04*** | (2006.01) |
| ***F24H 9/20*** | (2006.01) |
| ***F24D 19/10*** | (2006.01) |

(52) U.S. Cl.

CPC ..... *F24D 17/0078* (2013.01); *E03B 7/045* (2013.01); *F24D 19/1051* (2013.01); *F24H 1/145* (2013.01); *F24H 9/2035* (2013.01); *F24D 2220/0207* (2013.01); *F24D 2220/0257* (2013.01); *Y10T 137/6497* (2015.04)

(58) Field of Classification Search

USPC ..... 122/14.3

See application file for complete search history.

(56) References Cited

U.S. PATENT DOCUMENTS

2015/0096504 A1* 4/2015 Ando ..... F24H 1/124 122/14.2
2015/0144074 A1* 5/2015 Fujimoto ..... F28G 15/003 122/14.21

FOREIGN PATENT DOCUMENTS

| | | | |
|---|---|---|---|
| JP | 8-121800 | A | 5/1996 |
| JP | 3070833 | U | 5/2000 |
| JP | 2011-247487 | A | 12/2011 |

OTHER PUBLICATIONS

Office Action dated Aug. 16, 2016, issued in counterpart Japanese Application No. 2014-117875, with machine translation. (4 pages).

* cited by examiner

*Primary Examiner* — Alissa Tompkins
*Assistant Examiner* — John Bargero
(74) *Attorney, Agent, or Firm* — Westerman, Hattori, Daniels & Adrian, LLP

(57) ABSTRACT

A hot water supply apparatus has: a thermo-sensitive valve which is connected in parallel to a cold water delivery pipe and a hot water delivery pipe and which is closed when the hot water temperature to flow inside the valve is above a predetermined temperature to thereby shut off communication between the cold water delivery pipe and the hot water delivery pipe; and a circulation pump. By operation of the circulation pump, water circulation takes place from a heat exchanger through the hot water delivery pipe, a return pipe, the circulation pump, and a cold water supply pipe back to the heat exchanger. When the thermo-sensitive valve is open, water circulation takes place also through the thermo-sensitive valve. Instantaneous hot water supply operation is finished when an amount detected by a flow sensor falls below a predetermined amount during the instantaneous hot water supply operation.

1 Claim, 2 Drawing Sheets

HOT WATER SUPPLY APPARATUS

BACKGROUND OF THE INVENTION

1. Field of the Invention

The present invention relates to a hot water supply apparatus having an instantaneous hot water supply function.

2. Background of the Related Art

A conventional hot water supply apparatus having an instantaneous hot water supply function is provided with: a water heater having a burner and a heat exchanger for supplying hot water heated by combustion by the burner; a cold water supply pipe for introducing cold water from a cold water supply source into a cold water inlet of the heat exchanger; a hot water delivery pipe connected to a hot water outlet of the heat exchanger so as to introduce the hot water heated by the heat exchanger to a hot water supply terminal; a bypass pipe for introducing hot water from that portion of the hot water delivery pipe which is in the neighborhood of the hot water supply terminal into the cold water supply pipe; and a circulation pump interposed in the bypass pipe. By the operation of the circulation pump, the water is arranged to be circulated in a circulation path from the hot water outlet of the heat exchanger, the bypass pipe, the cold water supply pipe, back to the cold water inlet of the heat exchanger (see, e.g., JP-2011-247487A). Then by performing the instantaneous hot water supply operation in which the circulation pump is in operation and also the burner is in combustion, water circulation takes place in the circulation path while heating the water in the heat exchanger, whereby upon receipt of a request for hot water delivery, hot water at an appropriate temperature is arranged to be supplied with a good response to the hot water supply terminal. Further, according to this arrangement, during the instantaneous hot water supply operation, when the combustion by the burner has continued for a certain predetermined period of time, or when the hot water delivery temperature has exceeded a predetermined temperature, the instantaneous hot water supply operation is finished. (Note: In this specification, the expression of "that . . . which" e.g., "that portion of the hot water delivery pipe which is in the neighborhood of . . . " shall be understood to be equal in meaning to "such a portion of the hot water delivery pipe as is in the neighborhood of . . . ")

By the way, in case a mixing faucet (hot and cold water mixing valve) is used as the hot water supply terminal, the hot water delivery pipe is connected to a hot water inlet of the mixing faucet, and a cold water delivery pipe branched from the cold water supply pipe is connected to a cold water inlet of the mixing faucet. In this arrangement, the piping cost will become expensive if the bypass pipe must be provided to connect that portion of the hot water delivery pipe which is in the neighborhood of the mixing faucet to the cold water supply pipe, in addition to the cold water delivery pipe which extends to the mixing faucet that is located away from the water heater.

As a solution, there is also considered a conventional hot water supply apparatus provided with: a thermo-sensitive valve connected, in the neighborhood of the mixing faucet, to the cold water delivery pipe and to the hot water delivery pipe in parallel to the mixing faucet; a circulation pump parallelly connected to that portion of the cold water supply pipe which is on a downstream side of the branch of the cold water delivery pipe from the cold water supply pipe; and a return pipe for introducing, into a pump suction port of the circulation pump, the hot water from that portion of the hot water delivery pipe which is on the upstream side of the thermo-sensitive valve. The thermo-sensitive valve is arranged to be opened to bring the cold water delivery pipe into communication with the hot water delivery pipe when the temperature of the hot water to flow inside the thermo-sensitive valve is below a predetermined temperature, and to be closed to shut off the communication between the cold water delivery pipe and the hot water delivery pipe when the temperature of the hot water to flow inside the thermo-sensitive valve is above the predetermined temperature. It is thus so arranged that, by the operation of the circulation pump, water circulation takes place in a first circulation path from the hot water outlet of the heat exchanger through the return pipe, the circulation pump, and the cold water supply pipe back into the cold water inlet of the heat exchanger and, at the same time, when the thermo-sensitive valve is opened, water circulation takes place also in a second circulation path from the hot water outlet of the heat exchanger through the hot water delivery pipe, the thermo-sensitive valve, the cold water delivery pipe, the circulation pump, and the cold water supply pipe back to the cold water inlet of the heat exchanger. According to this arrangement, at the time of performing instantaneous hot water supply operation in which the circulation pump is in operation and also the burner is in combustion, it is possible to circulate the cold water in the second circulation path while heating it by the heat exchanger, thereby keeping the heated hot water supplied up to the neighborhood of the mixing faucet. As a consequence, it is not necessary to provide the apparatus with the above-described bypass pipe, thereby reducing the piping costs.

In this arrangement, however, if the instantaneous hot water supply operation is finished when the combustion by the burner has continued for a predetermined period of time during the instantaneous hot water supply operation, or when the hot water delivery temperature has exceeded a predetermined temperature during the instantaneous hot water supply operation, the following disadvantages will occur. In other words, the length of piping from the water heater to the mixing faucet varies from site of one installation to site of another installation. Therefore, if the instantaneous hot water supply operation is finished when the combustion has continued for a predetermined period of time, the temperature of the circulated water, in case of a long piping length, will not rise sufficiently at the time of finishing the instantaneous hot water supply operation. In case of a short piping length, on the other hand, the temperature of the circulated water will be excessively high at the time of finishing the instantaneous hot water supply operation. In this manner, the instantaneous hot water supply operation becomes too much or too little in operation. In addition, the hot water delivery temperature is detected by a hot water delivery temperature sensor for detecting the hot water temperature in the hot water delivery pipe disposed in the water heater. Therefore, before the temperature of the water in the neighborhood of the mixing faucet that is far from the water heater has been elevated sufficiently, the temperature as detected by the hot water delivery temperature sensor will be above the predetermined temperature, whereby the instantaneous hot water supply operation will be finished. As a result, the instantaneous hot water supply operation will result in a shortage of operation.

SUMMARY

Problems that the Invention is to Solve

In view of the above-described points, this invention has a problem of providing a hot water supply apparatus which has a thermo-sensitive valve and which is capable of performing an instantaneous hot water supply operation without too much or too little instantaneous hot water supply operation.

Means for Solving the Problems

In order to solve the above problems, this invention is a hot water supply apparatus comprising: a water heater having a burner and a heat exchanger for supplying hot water heated by combustion by the burner; a cold water supply pipe for introducing cold water from a cold water supply source into a cold water inlet of the heat exchanger; a cold water delivery pipe branched from the cold water supply pipe so as to introduce the cold water from the cold water supply source to a cold water inlet of a mixing faucet which is a hot water supply terminal; a hot water delivery pipe connected to a hot water outlet of the heat exchanger so as to introduce the hot water heated by the heat exchanger to a hot water inlet of the mixing faucet; a thermo-sensitive valve connected to the cold water delivery pipe and to the hot water delivery pipe in parallel to the mixing faucet so as to be opened when the temperature of hot water flowing inside the thermo-sensitive valve is below a predetermined temperature, thereby bringing the cold water delivery pipe and the hot water delivery pipe into communication with each other, and so as to be closed when the temperature of hot water flowing inside the thermo-sensitive valve is above the predetermined temperature, thereby shutting off the communication between the cold water delivery pipe and the hot water delivery pipe; a circulation pump parallelly connected to such a portion of the cold water supply pipe as is on a downstream side of a branch of the cold water delivery pipe from the cold water supply pipe; a return pipe for introducing hot water from such a portion of the hot water delivery pipe as is on an upstream side of the thermo-sensitive valve into a pump suction port of the circulation pump. By operation of the circulation pump, water circulation takes place in a first circulation path from the hot water outlet of the heat exchanger, through the hot water delivery pipe, the return pipe, the circulation pump, and the cold water supply pipe, back to the cold water inlet of the heat exchanger and, when the thermo-sensitive valve is open, water circulation takes place also in a second circulation path from the hot water outlet of the heat exchanger, through the hot water delivery pipe, the thermo-sensitive valve, the cold water delivery pipe, the circulation pump, and the cold water supply pipe, back to the cold water inlet of the heat exchanger. The hot water supply apparatus further comprises: a flow sensor interposed in such a portion of the cold water supply pipe as is on a downstream side of a connection of the circulation pump to the cold water supply pipe or in such a portion of the hot water delivery pipe as is on an upstream side of a connection of the return pipe to the hot water delivery pipe; and a control means. During an instantaneous hot water supply operation in which the circulation pump is in operation and also the burner is in combustion, the control means finishes the instantaneous hot water supply operation if the detected flow amount as detected by the flow sensor has fallen below a predetermined amount as a result of closing of the thermo-sensitive valve.

When the hot water inside the thermo-sensitive valve exceeds the predetermined temperature during the instantaneous hot water supply operation, the thermo-sensitive valve is closed and the circulation of water through the second circulation path stops and, as a result, the flow rate detected by the flow sensor falls below the predetermined amount. Therefore, according to this invention, by making the position of disposing the thermo-sensitive valve to be in the neighborhood of the mixing faucet, the instantaneous hot water supply operation will be finished when the temperature of the hot water inside the thermo-sensitive valve to be in the neighborhood of the mixing faucet, the instantaneous hot water supply operation will be finished when the temperature of the hot water inside the thermo-sensitive valve during the instantaneous hot water supply operation, i.e., the temperature of the hot water to be supplied to that portion of the hot water delivery pipe which is in the neighborhood of the mixing faucet, exceeds the predetermined temperature. Therefore, it is possible to perform the instantaneous hot water supply operation without excess or shortage of operation.

DESCRIPTION OF PREFERRED EMBODIMENTS

Figure 1:
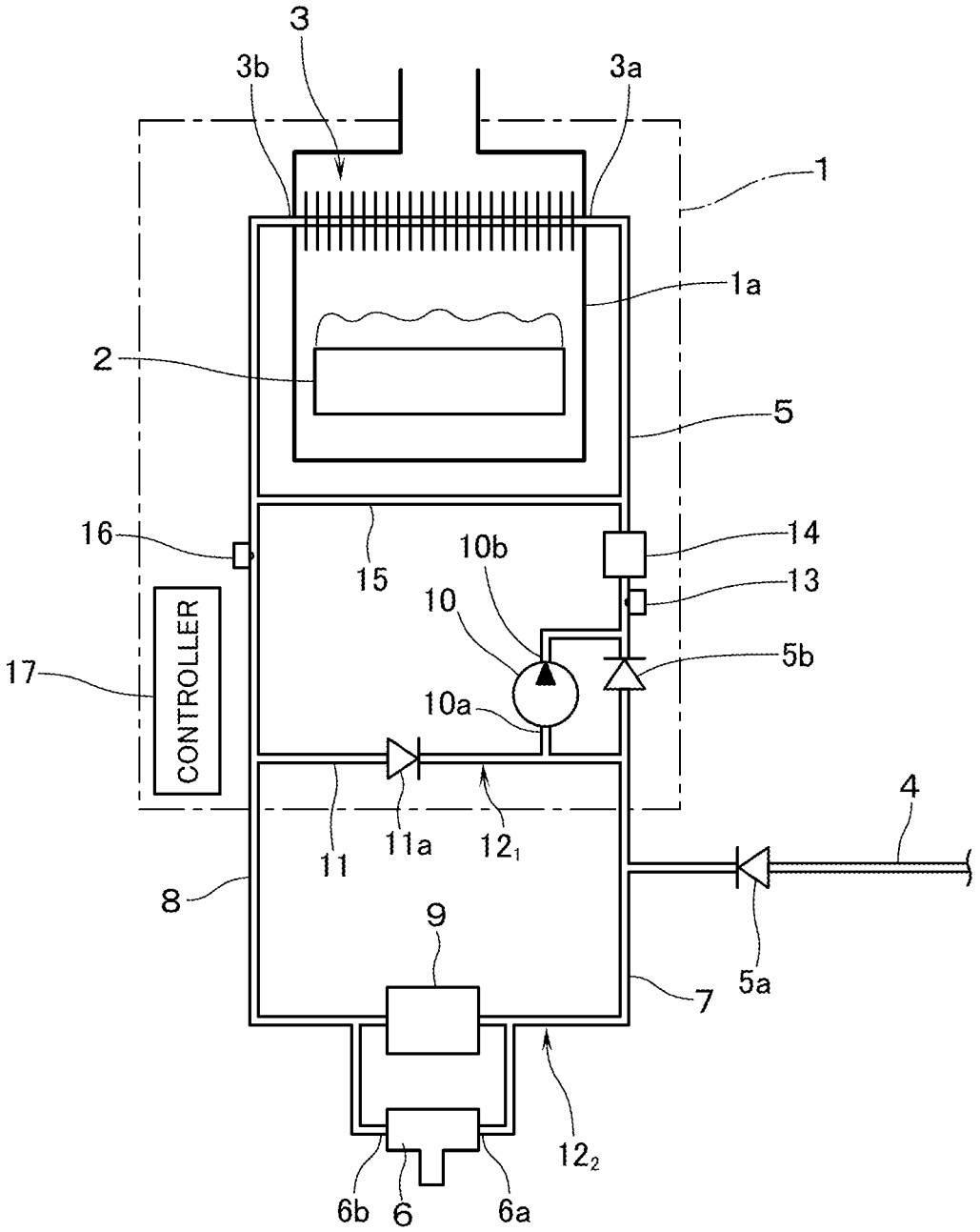
FIG. 1 is a schematic diagram showing an arrangement of a hot water supply apparatus according to an embodiment of this invention.

With reference to FIG. 1, reference numeral 1 denotes a water heater which is a main constituting element of a hot water supply apparatus according to an embodiment of this invention. This water heater 1 is provided with a burner 2 housed inside a combustion chamber 1*a*, and a heat exchanger 3 for supplying hot water heated by the combustion by the burner 2.

The hot water supply apparatus is further provided with: a cold water supply pipe 5 connected to a cold water supply source 4 such as publicly managed water supply, etc. through a check valve 5*a* so as to introduce the cold water from the cold water supply source 4 to a cold water inlet 3*a* of the heat exchanger 3; a cold water delivery pipe 7 for introducing the cold water from the cold water supply source 4 to a cold water inlet 6*a* of a mixing faucet 6 which is a hot water supply terminal; a hot water delivery pipe 8 which is connected to a hot water outlet 3*b* of the heat exchanger 3 and which introduces the hot water heated by the heat exchanger 3 into a hot water inlet 6*b* of the mixing faucet 6; a thermo-sensitive valve 9 connected, in the neighborhood of the mixing faucet 6, to the cold water delivery pipe 7 and to the hot water delivery pipe 8 in parallel to the mixing faucet 6; a circulation pump 10 inside the water heater 1 such that the circulation pump is parallelly connected to the cold water supply pipe 5 at a portion on the downstream side of a branch of the cold water delivery pipe 7 from the cold water supply pipe 5; and a return pipe 11, with a check valve 11*a* interposed therein, for introducing into a pump suction port 10*a* of the circulation pump 10, the hot water from that portion of the hot water delivery pipe 8 which is on an upstream side of the thermo-sensitive valve 9.

The thermo-sensitive valve 9 opens to bring the cold water delivery pipe 7 and the hot water delivery pipe 8 into communication with each other when the temperature of the hot water to flow inside the thermo-sensitive valve 9 is below a predetermined temperature (e.g., 35° C.), and closes to shut off the communication between the cold water delivery pipe 7 and the hot water delivery pipe 8 when the temperature of the hot water to flow inside the thermo-sensitive valve 9 is above the predetermined temperature. Then, by the operation of the circulation pump 10, water circulation takes place in a first circulation path $\mathbf{12}_1$ from the hot water outlet 3*b* of the heat exchanger 3 through the hot water delivery pipe 8, the return pipe 11, the circulation pump 10, and the cold water supply pipe 5 back to the cold water inlet 3*a* of the heat exchanger 3. When the thermo-sensitive valve 9 is open, water circulation takes place also in a second circulation path $\mathbf{12}_2$ from the hot water outlet 3*b* of the heat exchanger 3 through the hot water delivery pipe 8, the thermo-sensitive valve 9, the cold water delivery pipe 7, the circulation pump 10, and the cold water supply pipe 5 back to the cold water inlet 3*a* of the heat exchanger 3.

The cold water supply pipe 5 has interposed therein a check valve 5*b* parallelly connected between the pump suction port 10*a* and a pump outlet port 10*b* of the circulation pump 10. Further, on that side of the cold water supply pipe 5 which lies on the downstream side of the connection of the circulation pump 10 to the cold water supply pipe 5, there are interposed a cold water inlet temperature sensor 13 and a flow sensor 14. Further, there is provided a bypass 15 which is in parallel to the heat exchanger 3 and which connects together that portion of the cold water supply pipe 5 which is on the downstream side of the flow sensor 14 and that portion of the hot water delivery pipe 8 which is on the upstream side of the connection of the return pipe 11 to the hot water delivery pipe 8. A hot water outlet temperature sensor 16 is disposed in that portion of the hot water delivery pipe 8 which is on the downstream side of the connection of the bypass 15 to the hot water delivery pipe 8.

Further, the water heater 1 is provided with a controller 17, which is a control means, made up of a microcomputer to control the burner 2 and the circulation pump 10. The controller 17 performs hot water supply control when the mixing faucet 6 is opened to deliver hot water. In the hot water supply control, feed forward control is performed of the combustion amount of the burner 2 depending on the hot water feed load to be computed by the difference between the hot water supply set temperature as set by a remote controller (not illustrated) and a detected temperature of the cold water inlet temperature sensor 13, as well as by the detected flow amount as detected by the flow sensor 14. Also feedback control is performed of the combustion amount of the burner 2 so that the detected temperature as detected by the hot water outlet temperature sensor 16 attains a hot water outlet set temperature.

Figure 2:
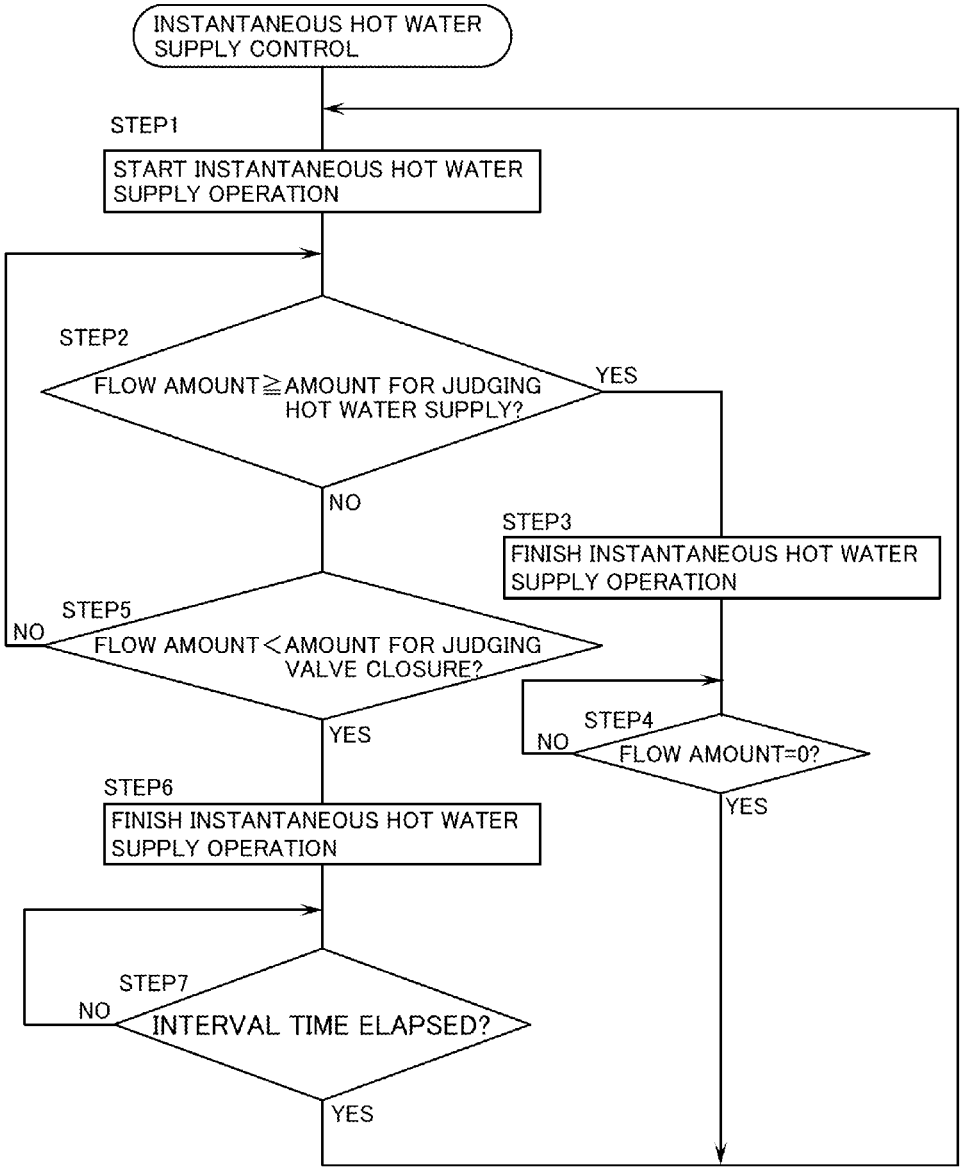
FIG. 2 is a flow chart showing the particulars of instantaneous hot water supply operation performed by the hot water supply apparatus according to this embodiment.

The controller 17 further performs instantaneous hot water supply control when an instantaneous hot water supply switch provided in the remote controller is switched on. With reference to FIG. 2, a description will now be made of the instantaneous hot water supply control. In the instantaneous hot water supply control, first, in STEP 1 the circulation pump 10 is operated and the combustion by the burner 2 is started, thereby starting the instantaneous hot water supply operation.

Then, the procedure goes to STEP 2, where discrimination is made as to whether the detected flow amount as detected by the flow sensor 14 has become equal to or above a predetermined amount for judging the hot water supply. The amount for judging the hot water supply is set slightly higher than a reference amount which is based on the flow amount when both the first and the second circulation paths are circulated with water by the operation of the circulation pump 10. Then, by opening the mixing faucet 6, the delivery of hot water is started. When the amount as detected by the flow sensor 14 has exceeded the amount for judging the hot water supply, the procedure goes to STEP 3, thereby finishing the instantaneous hot water supply operation. Thereafter, in STEP 4, discrimination is made as to whether the detected flow amount as detected by the flow sensor 14 has become zero or not. When the mixing faucet 6 is closed and consequently the supply of hot water is stopped so that the detected flow amount has become zero, the procedure returns to STEP 1 to thereby resume the instantaneous hot water supply operation.

When discrimination is made in STEP 2 that the detected flow amount of the flow sensor 14 is below the amount for judging the hot water supply, the procedure goes to STEP 5 to discriminate whether the detected flow amount of the flow sensor 14 is below a predetermined amount for judging as to whether the valve shall be closed or not (also referred to as "the amount for judging the valve closure"). The amount for judging the valve closure is set slightly lower than the above-described reference amount. When the thermo-sensitive valve 9 is closed and the water circulation through the second circulation path is stopped, the detected flow amount of the flow sensor 14 falls below the amount for judging the valve closure. In this case, the procedure goes to STEP 6, where the instantaneous hot water supply operation is finished. Thereafter in STEP 7, discrimination is made as to whether a predetermined interval time has elapsed or not. When the interval time has elapsed after finishing the instantaneous hot water supply operation, the procedure returns to STEP 1, where the instantaneous hot water supply operation is resumed.

According to this embodiment, when the hot water temperature inside the thermo-sensitive valve 9 has exceeded the predetermined temperature and the thermo-sensitive valve 9 is closed, the instantaneous hot water supply operation is finished. Here, the thermo-sensitive valve 9 is disposed in the neighborhood of the mixing faucet 6. Therefore, when the hot water temperature inside the thermo-sensitive valve 9 exceeds the predetermined temperature, the temperature of the hot water to be delivered to that portion of the hot water delivery pipe 8 which is in the neighborhood of the mixing faucet 6 will also exceed the predetermined temperature. Since the instantaneous hot water supply operation is finished at this point of time, the instantaneous hot water supply operation can be performed without shortage or excess of operation.

Description has so far been made of an embodiment of this invention with reference to the drawings, but this invention shall not be limited to the above. For example, in the above-described embodiment, the flow sensor 14 is interposed in that portion of the cold water supply pipe 5 which lies on the downstream side of the connection of the circulation pump 10 to the cold water supply pipe 5. The flow sensor may, alternatively, be interposed in that portion of the hot water delivery pipe 8 which lies on the upstream side of the connection of the return pipe 11 to the hot water delivery pipe 8.

EXPLANATION OF REFERENCE MARKS

| | | | |
|---|---|---|---|
| 1 | water heater | 2 | burner |
| 3 | heat exchanger | 3a | cold water inlet |
| 3b | hot water outlet | 4 | cold water supply source |
| 5 | cold water supply pipe | 6 | mixing faucet (hot and cold water mixing valve) |
| 6a | cold water inlet | 7 | cold water delivery pipe |
| 8 | hot water delivery pipe | 9 | thermo-sensitive valve |
| 10 | circulation pump | 10a | pump suction port |

-continued

| | | | |
|---|---|---|---|
| 11 | return pipe | $12_1$ | first circulation path |
| $12_2$ | second circulation path | 4 | flow sensor |
| 17 | controller (control means) | | |

What is claimed is:

1. A hot water supply apparatus comprising:

a water heater having a burner and a heat exchanger for supplying hot water heated by combustion by the burner;

a cold water supply pipe for introducing cold water from a cold water supply source into a cold water inlet of the heat exchanger;

a cold water delivery pipe branched from the cold water supply pipe so as to introduce the cold water from the cold water supply source to a cold water inlet of a mixing faucet which is a hot water supply terminal;

a hot water delivery pipe connected to a hot water outlet of the heat exchanger so as to introduce the hot water heated by the heat exchanger to a hot water inlet of the mixing faucet;

a thermo-sensitive valve connected to the cold water delivery pipe and to the hot water delivery pipe in parallel to the mixing faucet so as to be opened when the temperature of hot water flowing inside the thermo-sensitive valve is below a predetermined temperature, thereby bringing the cold water delivery pipe and the hot water delivery pipe into communication with each other, and so as to be closed when the temperature of hot water flowing inside the thermo-setting valve is above the predetermined temperature, thereby shutting off the communication between the cold water delivery pipe and the hot water delivery pipe;

a circulation pump parallelly connected to such a portion of the cold water supply pipe as is on a downstream side of a branch of the cold water delivery pipe from the cold water supply pipe;

a return pipe for introducing hot water from such a portion of the hot water delivery pipe as is on an upstream side of the thermo-sensitive valve into a pump suction port of the circulation pump;

whereby, by operation of the circulation pump, water circulation takes place in a first circulation path from the hot water outlet of the heat exchanger, through the hot water delivery pipe, the return pipe, the circulation pump, and the cold water supply pipe, back to the cold water inlet of the heat exchanger and, when the thermo-sensitive valve is open, water circulation takes place also in a second circulation path from the hot water outlet of the heat exchanger, through the hot water delivery pipe, the thermo-sensitive valve, the cold water delivery pipe, the circulation pump, and the cold water supply pipe, back to the cold water inlet of the heat exchanger, the hot water supply apparatus further comprising:

a flow sensor interposed in such a portion of the cold water supply pipe as is on a downstream side of a connection of the circulation pump to the cold water supply pipe or in such a portion of the hot water delivery pipe as is on an upstream side of a connection of the return pipe to the hot water delivery pipe; and a controller configured such that during an instantaneous hot water supply operation in which the circulation pump is in operation and also the burner is in combustion the controller controls the hot water supply apparatus to finish the instantaneous hot water supply operation if the detected flow amount as detected by the flow sensor has fallen below a predetermined amount as a result of closing of the thermo-sensitive valve.

* * * * *